US011370219B2

(12) United States Patent
Tse et al.

(10) Patent No.: US 11,370,219 B2
(45) Date of Patent: Jun. 28, 2022

(54) MULTI-NOZZLE ELECTROHYDRODYNAMIC PRINTING

(71) Applicant: The Regents of the University of Michigan, Ann Arbor, MI (US)

(72) Inventors: Lai Yu Leo Tse, Ann Arbor, MI (US); Kira Barton, Ann Arbor, MI (US); Ethan John McMillan, Grand Haven, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 0 days.

(21) Appl. No.: 17/017,644

(22) Filed: Sep. 10, 2020

(65) Prior Publication Data

US 2021/0070043 A1 Mar. 11, 2021

Related U.S. Application Data

(60) Provisional application No. 62/898,193, filed on Sep. 10, 2019.

(51) Int. Cl.

| | |
|---|---|
| ***B41J 2/06*** | (2006.01) |
| ***B41J 2/10*** | (2006.01) |
| ***B41J 2/085*** | (2006.01) |
| ***B41J 2/145*** | (2006.01) |

(52) U.S. Cl.

CPC ..... *B41J 2/085* (2013.01); *B41J 2/06* (2013.01); *B41J 2/10* (2013.01); *B41J 2/145* (2013.01); *B41J 2202/02* (2013.01)

(58) Field of Classification Search

CPC ..... B41J 2/085; B41J 2/06; B41J 2/145; B41J 2/072; B41J 2/10; B41J 2202/02

See application file for complete search history.

(56) References Cited

U.S. PATENT DOCUMENTS

| | | | | |
|---|---|---|---|---|
| 6,154,226 | A * | 11/2000 | York | B41J 2/005 347/55 |
| 9,415,590 | B2 | 8/2016 | Barton et al. | |
| 2014/0322451 | A1* | 10/2014 | Barton | B41J 2/06 427/466 |
| 2018/0104947 | A1* | 4/2018 | Poulikakos | B41J 2/04505 |

FOREIGN PATENT DOCUMENTS

| | | | | |
|---|---|---|---|---|
| JP | 2008516766 | A * | 5/2008 | B03C 3/16 |

* cited by examiner

*Primary Examiner* — Yaovi M Ameh

(74) *Attorney, Agent, or Firm* — Reising Ethington P.C.

(57) ABSTRACT

An electrohydrodynamic print head includes a plurality of nozzles and a common electrode. Separately controllable electrostatic fields between the common electrode and each nozzle are provided. The common electrode can also shield adjacent electrostatic fields from each other. Each nozzle can be associated with separately controllable gas flow fields and separately back pressures. The print head enables simultaneous e-jet printing of different printing fluids and/or different resolutions. The print head may be part of a printing system with interchangeable cartridges. Each cartridge has multiple nozzles, and printing fluid extraction parameters can be made separately controllable for each nozzle.

20 Claims, 3 Drawing Sheets

MULTI-NOZZLE ELECTROHYDRODYNAMIC PRINTING

TECHNICAL FIELD

The present disclosure relates generally to printing and, more particularly, to electrohydrodynamic printing.

BACKGROUND

Electrohydrodynamic printing, also known as e-jet printing, is a printing technique that relies on an electric field to extract droplets of a charged or polarized printing fluid from a printing nozzle. E-jet printing is capable of very high-resolution printing compared to other drop-on-demand printing methods with droplet size and spatial accuracy on a sub-micron or nanometer scale. Early e-jet printing was limited to electrically conductive printing surfaces because the printing surface was one of the electrodes between which the electric field was produced. Consistency with the electric field was also problematic due to the deposited ink causing interference with the field as printing progressed. U.S. Pat. No. 9,415,590 to Barton, et al. addressed these and other problems via clever ink extraction and directing techniques that did not rely on a conductive printing surface. Other obstacles to larger-scale commercialization remain.

SUMMARY

In accordance with various embodiments, an electrohydrodynamic print head includes a plurality of nozzles and a common electrode at a fixed position relative to the nozzles. The print head is configured to provide separately controllable electrostatic fields between the common electrode and each nozzle.

In some embodiments, the common electrode includes a plurality of extraction openings. Each extraction opening is aligned with one of the nozzles such that printing fluid extracted from each nozzle passes through the respective extraction opening for deposition on a printing surface.

In some embodiments, the common electrode extends between adjacent nozzles in an axial direction of the nozzles to thereby shield the separately controllable electrostatic fields from each other.

In some embodiments, the print head is configured to provide a gas flow field in a direction toward a printing surface and in which printing fluid extracted from one or more of the nozzles travels toward the printing surface.

In some embodiments, the print head is configured to provide a plurality of separately controllable gas flow fields. Each gas glow field flows along one of the nozzles and in a direction toward a printing surface such that printing fluid extracted from each nozzle travels toward the printing surface in the respective gas flow field.

In some embodiments, the print head includes a plurality of extraction electrodes. Each extraction electrode is arranged to provide one of the separately controllable electrostatic fields when a voltage potential relative to the common electrode is applied to the respective extraction electrode.

In some embodiments, each nozzle comprises one of a plurality of extraction electrodes.

In some embodiments, the print head is configured to provide separately controllable back pressure on a printing fluid in each nozzle.

In some embodiments, each nozzle contains a different printing fluid.

In some embodiments, each nozzle contains the same printing fluid.

In some embodiments, each nozzle is spaced from the common electrode by a different amount in an axial direction.

In some embodiments, each nozzle includes an extraction opening at a tip of the nozzle, and each extraction opening has a different size.

In some embodiments, the print head includes a carrier and a printer cartridge. The printer cartridge includes a housing, the plurality of nozzles, and the common electrode. The carrier supports the printer cartridge for relative movement over a printing surface. The housing provides connectivity for a voltage source for an extraction electrode, a pressurized gas source for a gas flow field in which extracted printing fluid travels toward the printing surface, and/or a backpressure source for application to printing fluid in the nozzles.

In some embodiments, a printer cartridge is removably supported by a carrier for replacement with a different printer cartridge comprising a housing with connectivity for a voltage source, a pressurized gas source, and/or a backpressure source.

In accordance with various embodiments, an electrohydrodynamic printing system includes a plurality of printer cartridges and a carrier. Each printer cartridge includes a housing, a plurality of nozzles, and a common electrode at a fixed position relative to the nozzles. The carrier is configured to interchangeably support each one of the printer cartridges individually for relative movement over a printing surface. The housing of each printer cartridge provides connectivity for at least one of the following when the corresponding printer cartridge is being supported by the carrier: a voltage source for an extraction electrode of the cartridge, a pressurized gas source for a gas flow field in the cartridge in which extracted printing fluid travels toward the printing surface, and a backpressure source for application to printing fluid in the nozzles of the cartridge. The printing system is configured to provide separately controllable electrostatic fields between the common electrode and each nozzle of the same cartridge when the respective cartridge is being supported by the carrier.

In some embodiments, each nozzle of each cartridge is configured for a respective printing fluid, an extraction opening of each nozzle and a distance of each nozzle from the common electrode are a function of the respective printing fluid, and at least one of the nozzles of one of the cartridges is configured for a different printing fluid than another one of the nozzles of one of the cartridges.

In some embodiments, a first one of the cartridges is configured for use with a first printing fluid in each nozzle and a second one of the cartridges is configured for use with a different second printing fluid in each nozzle.

In some embodiments, one of the nozzles of one of the cartridges is configured for use with a different printing fluid than another one of the nozzles of the same cartridge.

It is contemplated that any number of the individual features of the above-described embodiments and of any other embodiments depicted in the drawings or the description below can be combined in any combination to define an invention, except where features are incompatible.

BRIEF DESCRIPTION OF THE DRAWINGS

One or more embodiments of the invention will hereinafter be described in conjunction with the appended drawings, wherein like designations denote like elements, and wherein.

DESCRIPTION OF EMBODIMENTS

Figure 1:
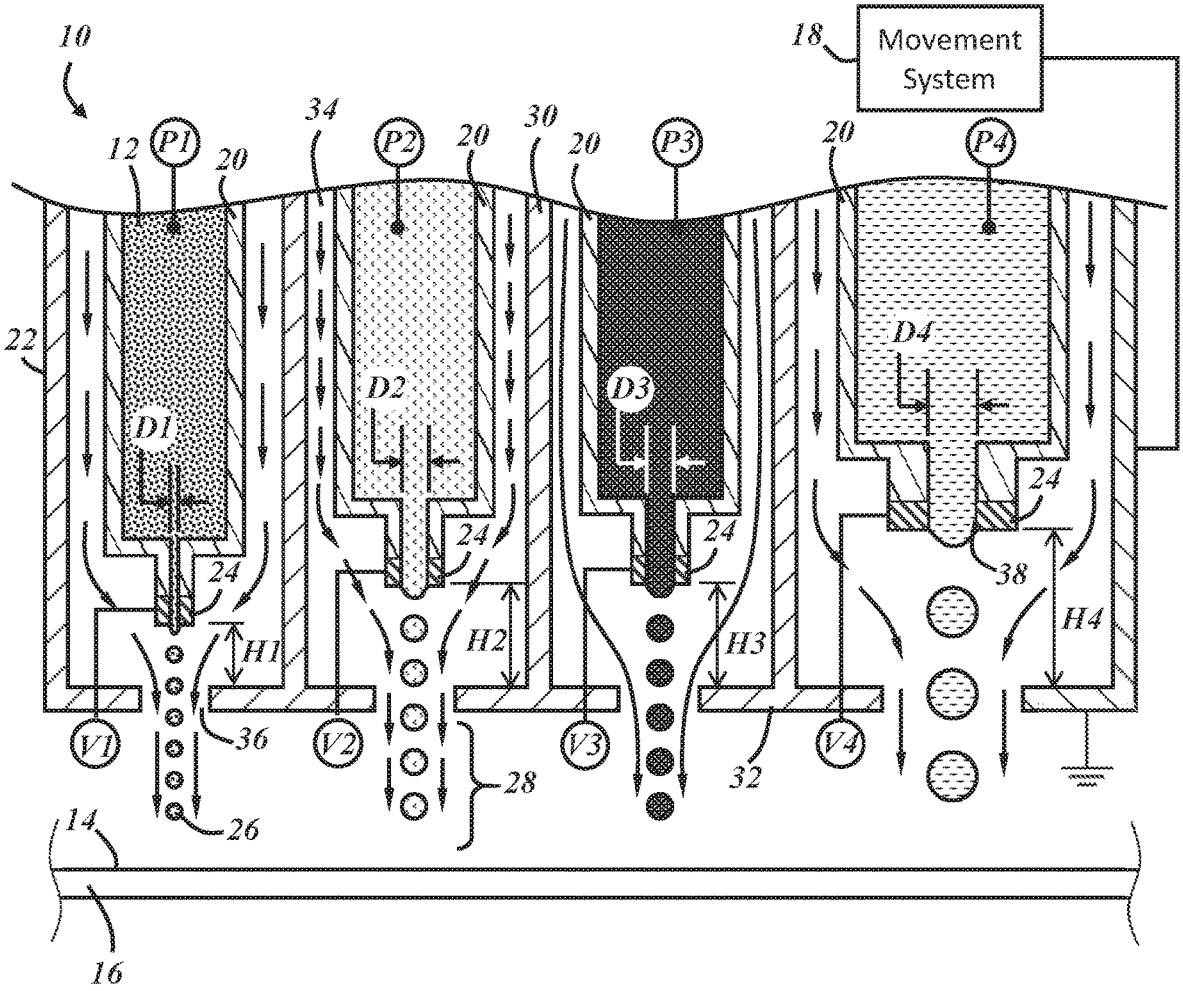
FIG. 1 is a schematic cross-sectional view of a portion of a multi-nozzle electrohydrodynamic print head.

FIG. 1 schematically illustrates an example of an electrohydrodynamic (i.e., e-jet) print head 10 configured to simultaneously deposit a plurality of different printing fluids 12 onto or over a printing surface 14, such as the surface of a substrate 16 or the exposed surface of an already printed pattern. A printing fluid is any fluid that flows under pressure and can be solidified after deposition. Solidification can be via various mechanisms, such as solvent evaporation, chemical reaction, cooling, or sintering. In some cases, the printing fluid is a functional ink, which is a printing fluid that provides a function other than coloration once solidified on the surface on which it is printed. Examples of such functions include electrical conductivity, dielectric properties, physical structure (e.g., stiffness, elasticity, or abrasion resistance), electromagnetic shielding or filtering, optical properties, electroluminescence, etc. For purposes of this description, one printing fluid is considered different from another printing fluid if their chemical compositions are different, including differences in amount. For instance, a 50/50 solution of two components has a different composition from a 60/40 solution of the same two components.

The print head 10 may be part of a larger e-jet printer or printing system, as described further below and which may include a movement system 18 configured to provide relative movement between the print head 10 and the substrate 16 such that the print head can be guided along a deposition pattern or path defined over the substrate. Multi-axis movement systems are generally known and may include axis-dedicated servos, guides, wheels, gears, belts, etc. One example of a suitable movement system 18 is disclosed by Barton et al. in U.S. Pat. No. 9,415,590. The movement system 18 may be configured to move the print head 10 back and forth along an axis while the substrate 16 is incrementally fed in a perpendicular direction after each pass of the print head, or the print head can be configured to move in any direction along a plane or three-dimensional contour while the substrate is held stationary. The print head 10 and/or the substrate 16 may be configured for relative translational movement in up to all three cartesian coordinate directions, for rotational movement about the associated axes, and for any combination of such movements to allow the print head to deliver printing fluids 12 in any direction and along any path on a substrate of any shape. The print head 10 could be affixed to the end of a robotic arm, for example.

The print head 10 of FIG. 1 includes a plurality of nozzles 20 and a common electrode 22 at a fixed position relative to the nozzles. The print head 10 is configured to provide separately controllable electrostatic fields between the common electrode 22 and each individual nozzle 20. In this example, the common electrode 22 is electrically grounded and the print head 10 includes a discrete extraction electrode 24 associated with and dedicated to each of the nozzles 20. Each extraction electrode 24 can be an integrated part of the associated nozzle 20 as shown, or the extraction electrodes can be provided as separate components from the nozzles. In one embodiment, each extraction electrode 24 is a layer of metal or other conductive material disposed at least along the tip of the corresponding nozzle 20. In some cases, an inner and/or outer surface of each nozzle 20 is coated with a conductive material, and in other cases a separately provided conductive tip is affixed at the end of each nozzle.

A baseline voltage with respect to the common electrode 22 may be maintained at each extraction electrode 24 to maintain a consistent Taylor cone of polarized printing fluid 12 at the tip of each nozzle 20 for extraction. When a sufficiently high voltage V1-V4 is applied to any one or more of the extraction electrodes 24, a droplet 26 of printing fluid 12 is released from the respective nozzle 20 and drawn in a direction toward the printing surface 14 via the net electrostatic force in that direction. Exemplary extraction voltages V1-V4 may range from 300V to 1000V, while the baseline voltage at each electrode 24 is lower than the respective extraction voltage, such as in a range from 10V to 300V. In various embodiments, the baseline voltage at each electrode 24 ranges from 200V to 300V and/or the extraction voltage ranges from 400V to 700V. These voltages depend on several factors, including the stand-off height H1-H4 of each nozzle 20 and various characteristics of the respective printing fluid 12 in each nozzle, such as viscosity, solids content, electrical conductivity, and polarizability, for example.

Stand-off height is a term of art related to conventional e-jet printing performed on a conductive substrate and is defined as the distance between the electrodes that generate the electrostatic field. In this case, each of the four illustrated nozzles 20 has a respective stand-off height H1-H4 measured between the common electrode 22 and the corresponding extraction electrode 24. Exemplary ranges for stand-off height H1-H4 are between 5 μm and 100 μm, between 10 μm and 60 μm, between 15 μm and 50 μm, between 20 μm and 40 μm, and between 25 μm and 35 μm. In some cases, such as when a relatively lower printing resolution is desired, the stand-off height can be up to 500 μm, or even up to 1 mm. Other exemplary ranges may be defined among any combination of the endpoints of these ranges. The stand-off height H1-H4 associated with each nozzle 20 may be a fixed distance for a given print head 10, and each stand-off height may have a particular value associated with a particular printing fluid composition. As illustrated in FIG. 1, nozzles 20 containing different printing fluids 12 may have different stand-off heights H1-H4.

The voltages V1-V4 at the extraction electrodes 24 are individually controllable, such as by a system controller. This control may include the magnitude, polarity, timing relative to print head and substrate positioning, pulse width, and pulse frequency of each applied voltage. The voltages V1-V4 may be applied as individually controllable electrical pulses having a pulse width ranging from 0.01 to 100 milliseconds. One non-limiting pulse width range is from 0.5 to 20 milliseconds. The size of the droplets 26 of printing fluid 12 is a function of pulse width, among other variables, such that pulse width may be one variable that affects the printing resolution. In the illustrated example, V1 may be applied with a smaller pulse width and at a greater frequency than V4, for example. As such, the illustrated print head 10 can simultaneously print multiple printing fluids 12 at different resolutions and/or with different printed line widths.

The common electrode 22 in the embodiment of FIG. 1 serves multiple functions. In addition to providing one of the poles of the individually controllable electrostatic fields at the nozzles 20, the common electrode 22 also electrically shields the individual fields from each other and provides a flow path for gas flow fields 28 that help direct extracted droplets 26 of printing fluid 12 toward the printing surface 14. The shielding is provided by walls 30 of the common electrode 22 extending between adjacent nozzles 20 of the print head 10. In this example, each wall 30 extends in an axial direction of the nozzles from a face plate 32 of the common electrode 22. These walls 30 may be made from the same conductive material as the face plate 32. The shielding helps minimize or eliminate cross-talk between adjacent nozzles 20 of the print head such that the electrostatic field generated at one nozzle does not adversely affect droplet formation at an adjacent nozzle, thereby maintaining individual control over the adjacent electrostatic fields and their corresponding printing fluid extraction. In other examples, shielding walls may extend from features other than the face plate 32 but may be considered part of the common electrode 22 when at the same electrical potential (e.g., ground).

The common electrode 22 of FIG. 1 also provides a plurality of gas flow channels 34, each of which is dedicated to an individual one of the nozzles 20. Each gas flow channel 34 is defined between one of the nozzles 20 and the common electrode 22. The shielding walls 30 thus serve this additional function. Each gas flow channel 34 is in fluidic communication with a gas source and is pressurized such that the gas flows along the respective flow channel toward an extraction opening 36 of the common electrode 22. A gas flow field 28 is thereby provided between the tip of each nozzle 20 and the printing surface 14. Each gas flow field 28 provides a directional aid for the extracted droplets 26 of printing fluid 12, particularly after each droplet passes through its corresponding extraction opening 36 and is between the face plate 32 and the printing surface 14—i.e., beyond the influence of the electrostatic field.

The gas or gases of each gas flow field 28 can serve other functions in addition to droplet directionality. For instance, the gas may include one or more constituents that promote curing of the printing fluid 12 once deposited. In one example, one of the gas flow fields 28 includes nitrogen in an amount higher than atmospheric air, such as substantially pure nitrogen, which is necessary for some functional inks to cure. In other examples, the flow field 28 is of a gas that is at least partially an inert gas (e.g., argon), which may serve to exclude reactive gases like oxygen from the droplets 26 of printing fluid during deposition. In another example, the gas includes water vapor which may promote curing of moisture-cure printing fluids. In some cases, one or more of the gas flow fields 28 may be made up of atmospheric air. The gas flowing along the channels 34 and in each gas flow field 28 may be heated or otherwise be maintained at a controlled temperature. The composition, temperature, and flow characteristics (e.g., pressure and flow rate) of the gas flow fields 28 and the gases in the flow channels 34 may be the same as or different from each other and individually controllable for each nozzle 20.

The illustrated print head 10 is also configured to provide separately controllable back pressure on the printing fluid 12 in each nozzle 20. The amount of back pressure P1-P4 in each nozzle may range from 5 psi to 30 psi (~35-200 kPa), depending on factors such as printing fluid viscosity. The back pressures are provided to ensure that the printing fluid 12 is continuously replenished at the tip of each nozzle as droplets 26 are extracted and deposited.

The size of an extraction opening 38 at the tip of each nozzle 20 may also vary among the nozzles of the print head 10. Depicted in FIG. 1 as diameters D1-D4, these dimensions may also affect and be used to control printing resolution. Extraction opening diameters D1-D4 may generally fall within a range from 0.25 μm to 10 μm. This range is non-limiting, however. For example, while e-jet printing may be lauded for its high resolution and deposition accuracy, such high resolution is not always necessary, particularly in view of the present teachings in which multiple different printing fluid compositions can be deposited from the same print head.

In a practical example, the illustrated print head 10 can fabricate a thermocouple on the printing surface 14. With reference to FIG. 1, the nozzles 20 associated with extraction voltages V2 and V3 may be configured to deposit separate lines of two different conductive inks, each including a different metal in the manner of a thermocouple. Each line of printed material may be about 10 μm wide, and the lines of printed material may be joined at a conductive junction at one end. The deposition of those two different conductive inks may be followed by deposition of a wider line (e.g., 50 μm) of an insulating material from the nozzle 20 associated with voltage V4, which has a larger extraction opening 38 in the nozzle 20 and a larger extraction opening 36 in the common electrode 22. The resolution of the printed insulating layer of the thermocouple is not required to be as high as that of the lines of conductive material.

An e-jet print head 10 is thus provided with multiple nozzles 20, each of which has its individual electrohydrodynamics determined by different voltage signals, back pressures, gas flow fields, stand-off heights, and nozzle size. For a given nozzle size (D1-D4) and stand-off height (H1-H4), each printing fluid 12 can be printed within a predetermined resolution range by varying the corresponding voltage signal (V1-V4) to provide different jetting frequencies and droplet sizes.

Figure 2:
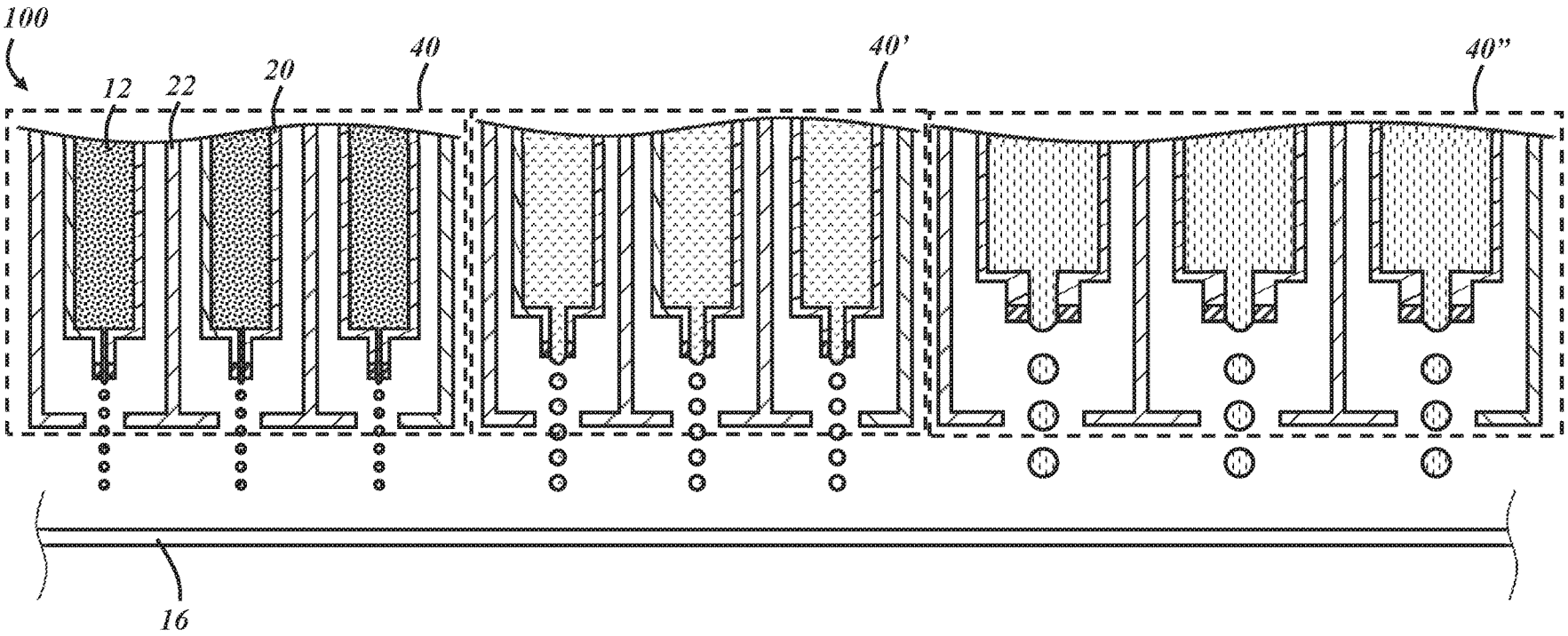
FIG. 2 is a schematic cross-sectional view of multiple electrohydrodynamic printer cartridges, each configured for use with different printing fluids.

In another implementation depicted in FIG. 2, an electrohydrodynamic printing system 100 is provided with multiple print head modules or cartridges 40, 40', 40", each of which includes multiple nozzles 20. Each module 40 includes its own common electrode 22 as with the print head 10 of FIG. 1. In the illustrated example, each module 40 is configured to print the same printing fluid 12 from each of its multiple nozzles 20, while the printing fluids among the different modules are different from each other. As such, the above-described stand-off height and nozzle size are the same for each nozzle 20 in a given module 40 and tailored for a particular printing fluid composition and printing resolution. In another example, each of the multiple modules 40 is configured to print the same printing fluid but at multiple different resolutions—i.e., the nozzles of one module have a different extraction opening size and/or a different stand-off height than the nozzles of another module. In yet another example, one or more of the multiple modules 40 is configured with multiple different printing fluids, stand-off heights, and nozzle sizes, as in FIG. 1.

A larger scale nozzle array is thus provided with multiple print head modules for different printing fluids and/or resolution. A gantry system or robot arm can pick-up and connect to one or more of the modules at a time and print different features accordingly. Each different module 40 can also be provided with different gas flow field compositions specific to the printing fluid(s) of the module.

Figure 3:
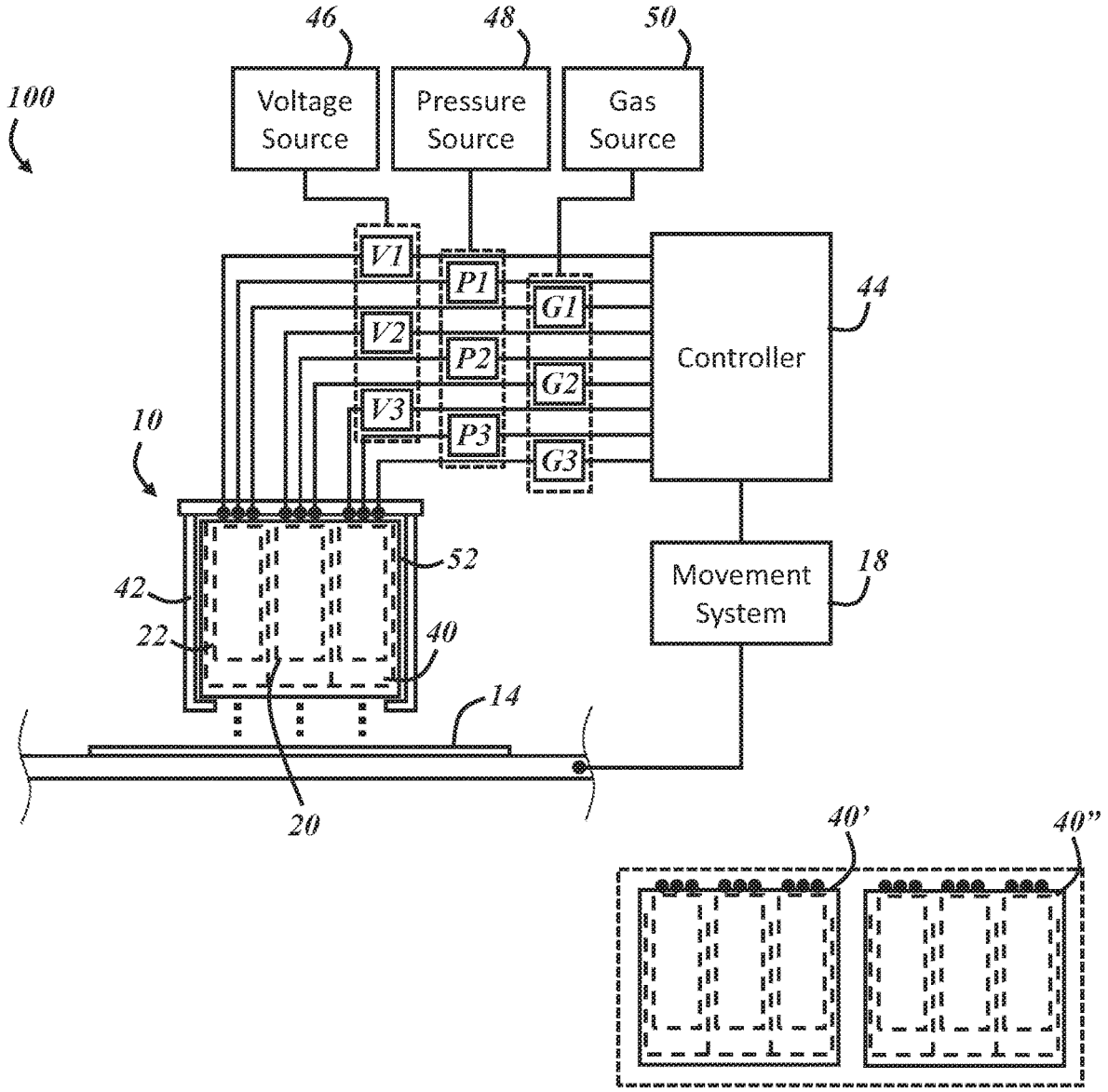
FIG. 3 is a schematic view of an electrohydrodynamic printing system with interchangeable cartridges.

An e-jet printing system 100 employing such a multi-module configuration is illustrated schematically in FIG. 3. The system 100 includes a plurality of printer cartridges 40-40", a carrier 42, the above-described movement system 18, and a controller 44. The system 100 also includes or is adapted for connections with a voltage source 46, a pressure source 48, and a gas source 50. The voltage source 46 is a power supply or other suitable source capable of providing the above-described voltage differentials between the common and extraction electrodes 22, 24 of each module. The pressure source 48 may be pneumatic or other suitable source (e.g., an electromechanically actuated plunger system) capable of providing the above-described back pressures on the printing fluids in the nozzles 20. The gas source 50 is a pressurized tank or other suitable source of the gas or gas mixture desired in the gas flow field associated with each nozzle. The gas source may include multiple separate pressurized gases of different compositions.

Each printer cartridge 40 includes a housing 52, a plurality of nozzles 20, and a common electrode 22 at a fixed position relative to the nozzles as discussed above. The carrier 42 is configured to interchangeably support each one of the printer cartridges 40-40" individually for relative movement over the printing surface 14. In some embodiments, the carrier 42 interchangeably supports more than one cartridge at a time, or the system 100 includes more than one separately operable carrier. The carrier 42 and the cartridge 40 being supported by the carrier at any given time together form the print head 10 of the system 100 such that a portion of the print head is interchangeable depending on the desired printing fluid or combination of printing fluids.

Each housing 52 provides connectivity for the controlled voltages V1-V3, the controlled back pressures P1-P3, and the controlled gases G1-G3 of the gas flow fields, each of which is provided at the carrier 42 by electrodes or fluid fittings for connection with the cartridge housing when the respective cartridge is fitted into and supported by the carrier. Each housing 52 of the various cartridges is equipped with the same connectivity so that they can be interchanged in and out of the carrier 42. The housing 52 of each cartridge may be formed by the common electrode 22 as in FIG. 1 or it may be or include one or more additional layers of material as in FIG. 3.

Each cartridge can be configured as in the print head of FIG. 1, with separately controllable extraction voltages, back pressures, and gas flow fields for each nozzle of the cartridge with the nozzles having different sizes and/or stand-off heights. Alternatively, each cartridge can be configured as in FIG. 2, with each nozzle having the same size and stand-off height, particular to a single type of printing fluid and/or resolution. In the configuration of FIG. 2, the individual extraction electrodes, back pressures, and gas flow fields may still be individually controllable even when the same printing fluid is in each of the nozzles. For instance, a three-nozzle cartridge or print head may be employed for reduced cycle time, with each nozzle only printing ⅓ of the desired pattern such that each nozzle is still required to deliver droplets of printing fluid independently to achieve the pattern. Individual control of back pressures and gas flow fields also remains useful even when the desired back pressures and gas flow fields are the same. Individual control of these parameters can provide methods of accommodating manufacturing variations in associated pressure lines and control valves, for example.

It is to be understood that the foregoing description is of one or more embodiments of the invention. The invention is not limited to the particular embodiment(s) disclosed herein, but rather is defined solely by the claims below. Furthermore, the statements contained in the foregoing description relate to the disclosed embodiment(s) and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Further, the term "electrically connected" and the variations thereof is intended to encompass both wireless electrical connections and electrical connections made via one or more wires, cables, or conductors (wired connections). Other terms are to be construed using their broadest reasonable meaning unless they are used in a context that requires a different interpretation.

The invention claimed is:

1. An electrohydrodynamic print head comprising a plurality of nozzles and a common electrode at a fixed position relative to the nozzles, wherein the print head is configured to provide separately controllable electrostatic fields between the common electrode and each nozzle, the print head further comprising:

a carrier;

a printer cartridge that includes a housing, the plurality of nozzles, and the common electrode, wherein the carrier supports the printer cartridge for relative movement over a printing surface, wherein the housing provides connectivity for at least one of the following: a voltage source for an extraction electrode, a pressurized gas source for a gas flow field in which extracted printing fluid travels toward the printing surface, and a backpressure source for application to printing fluid in the nozzles, and wherein the printer cartridge is removably supported by the carrier for replacement with a different printer cartridge comprising a housing with the same connectivity.

2. The print head of claim 1, wherein the common electrode includes a plurality of extraction openings, each extraction opening being aligned with one of the nozzles such that printing fluid extracted from each nozzle passes through the respective extraction opening for deposition on the printing surface.

3. The print head of claim 1, wherein the common electrode extends between adjacent nozzles in an axial direction of the nozzles to thereby shield the separately controllable electrostatic fields from each other.

4. The print head of claim 1, wherein the print head is configured to provide said gas flow field in a direction toward the printing surface.

5. The print head of claim 1, wherein the print head is configured to provide a plurality of separately controllable gas flow fields, each gas glow field flowing along one of the nozzles and in a direction toward a printing surface such that printing fluid extracted from each nozzle travels toward the printing surface in the respective gas flow field.

6. The print head of claim 1, further comprising a plurality of extraction electrodes, each extraction electrode being arranged to provide one of the separately controllable electrostatic fields when a voltage potential relative to the common electrode is applied to the respective extraction electrode.

7. The print head of claim 6, wherein each nozzle comprises one of the extraction electrodes.

8. The print head of claim 1, wherein the print head is configured to provide separately controllable back pressure on a printing fluid in each nozzle.

9. The print head of claim 1, wherein each nozzle contains a different printing fluid.

10. The print head of claim 1, wherein each nozzle contains the same printing fluid.

11. The print head of claim 1, wherein each nozzle is spaced from the common electrode by a different amount in an axial direction.

12. The print head of claim 1, wherein each nozzle includes an extraction opening at a tip of the nozzle, each extraction opening having a different size.

13. An electrohydrodynamic printing system comprising the print head of claim 1 and a movement system configured to provide said relative movement of each printer cartridge over a printing surface.

14. An electrohydrodynamic printing system, comprising:

a plurality of printer cartridges, each printer cartridge comprising a housing, a plurality of nozzles, and a common electrode at a fixed position relative to the nozzles; and a carrier configured to interchangeably support each one of the printer cartridges individually for relative movement over a printing surface, wherein the housing of each printer cartridge provides connectivity for at least one of the following when the corresponding printer cartridge is being supported by the carrier: a voltage source for an extraction electrode of the cartridge, a pressurized gas source for a gas flow field in the cartridge in which extracted printing fluid travels toward the printing surface, and a backpressure source for application to printing fluid in the nozzles of the cartridge, and wherein the printing system is configured to provide separately controllable electrostatic fields between the common electrode and each nozzle of the same cartridge when the respective cartridge is being supported by the carrier.

15. The printing system of claim 14, wherein each nozzle of each cartridge is configured for a respective printing fluid, an extraction opening of each nozzle and a distance of each nozzle from the common electrode being a function of the respective printing fluid, and at least one of the nozzles of one of the cartridges being configured for a different printing fluid than another one of the nozzles of one of the cartridges.

16. The printing system of claim 14, wherein a first one of the cartridges is configured for use with a first printing fluid in each nozzle and a second one of the cartridges is configured for use with a different second printing fluid in each nozzle.

17. The printing system of claim 14, wherein one of the nozzles of one of the cartridges is configured for use with a different printing fluid than another one of the nozzles of the same cartridge.

18. The printing system of claim 14, wherein the common electrode of at least one of the cartridges includes a plurality of extraction openings, each extraction opening being aligned with a respective one of the nozzles such that printing fluid extracted from each nozzle passes through the respective extraction opening for deposition on the printing surface.

19. The printing system of claim 14, wherein the system is configured to provide a plurality of separately controllable gas flow fields associated with each cartridge, each separately controllable gas flow field flowing along a respective one of the nozzles and in a direction toward the printing surface such that printing fluid extracted from each nozzle travels toward the printing surface in the respective gas flow field.

20. The printing system of claim 14, wherein at least one of the cartridges:

contains a different printing fluid in each nozzle, contains the same printing fluid in each nozzle, includes a different amount of spacing between the common electrode and each nozzle, or includes a differently sized extraction opening at a tip of each nozzle.

* * * * *